US005550009A

United States Patent [19]

Haye et al.

[11] Patent Number: 5,550,009

[45] Date of Patent: Aug. 27, 1996

[54] STABILIZED PEROXIDE BLEACHING SOLUTIONS AND THEIR USE FOR PROCESSING OF PHOTOGRAPHIC ELEMENTS

[75] Inventors: Shirleyanne E. Haye, Rochester, N.Y.; Mayra B. Reyes, Parkville, Puerto Rico

[73] Assignee: Eastman Kodak Company, Rochester, N.Y.

[21] Appl. No.: 422,468

[22] Filed: Apr. 17, 1995

[51] Int. Cl.[6] ..... G03C 7/00; G03C 5/44; G03C 5/18; G03C 5/26

[52] U.S. Cl. ..... 430/393; 430/943; 430/430; 430/461; 430/488; 430/490; 430/491; 430/493

[58] Field of Search ..... 430/943, 393, 430/430, 461, 488, 491, 490, 493

[56] References Cited

U.S. PATENT DOCUMENTS

| | | | |
|---|---|---|---|
| 4,277,556 | 7/1981 | Koboshi et al. | 430/393 |
| 4,301,236 | 11/1981 | Idota et al. | 430/393 |
| 4,454,224 | 6/1984 | Brien et al. | 430/393 |
| 5,250,402 | 10/1993 | Okada et al. | 430/393 |
| 5,300,408 | 4/1994 | Okada et al. | 430/393 |
| 5,460,924 | 10/1995 | Buchanan et al. | 430/393 |

FOREIGN PATENT DOCUMENTS

| | | | |
|---|---|---|---|
| 661358 | 3/1965 | Belgium | 430/393 |
| 428101A1 | 5/1991 | European Pat. Off. . | |
| 50-26542 | 3/1975 | Japan . | |
| 51-7930 | 1/1976 | Japan . | |
| 53-48527 | 5/1978 | Japan . | |
| 55-67747 | 5/1980 | Japan | 430/488 |
| 61-50140 | 3/1986 | Japan | 430/430 |
| 4-349109 | 12/1992 | Japan . | |
| 5-165176 | 6/1993 | Japan | 430/430 |
| 92/07300 | 4/1992 | WIPO . | |
| 93/11459 | 6/1993 | WIPO . | |

*Primary Examiner*—Charles L. Bowers, Jr.
*Assistant Examiner*—J. Pasterczyk
*Attorney, Agent, or Firm*—J. Lanny Tucker

[57] ABSTRACT

Color photographic elements are bleached after exposure and development by using a peroxide bleaching solution. This solution comprises a peroxide bleaching agent, chloride ions in an amount of at least 0.35 mol/l, a first acid which is a which is an organic phosphonic acid or a salt thereof, and a second acid which is a 2-pyridinecarboxylic acid or 2,6-pyridinedicarboxylic acid, or a salt thereof. The bleaching solution is stabilized by the presence of the two sequestering acids.

18 Claims, 1 Drawing Sheet

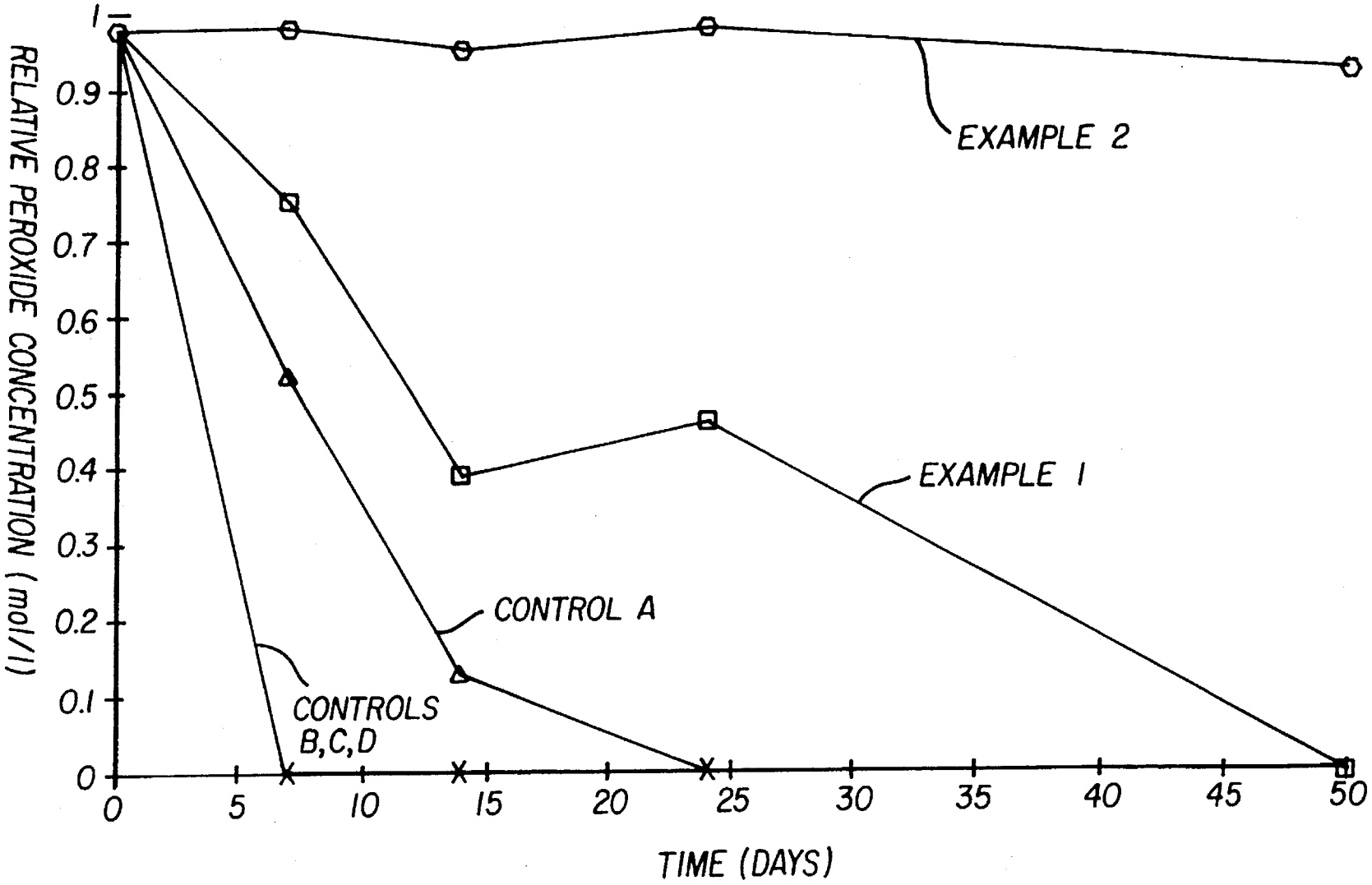
EXAMPLE 2
EXAMPLE 1
CONTROL A
CONTROLS B,C,D
RELATIVE PEROXIDE CONCENTRATION (mol/l)
1
0.9
0.8
0.7
0.6
0.5
0.4
0.3
0.2
0.1
0
TIME (DAYS)
0
5
10
15
20
25
30
35
40
45
50

STABILIZED PEROXIDE BLEACHING SOLUTIONS AND THEIR USE FOR PROCESSING OF PHOTOGRAPHIC ELEMENTS

FIELD OF THE INVENTION

The present invention relates generally to the processing of color photographic elements. More particularly, it relates to the use of stabilized peroxide bleaching solutions comprising a certain amount of chloride ion and two distinct sequestering acids. The compositions and the methods for their use in photography are the subject of this invention.

BACKGROUND OF THE INVENTION

During processing of silver halide photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions which are more compatible with the environment, and thus it is desirable to reduce or avoid the use of ferric complex bleaching agents.

Peracid bleaching solutions, such as those containing peroxide, persulfate, perborate, perphosphate, perhalogen, percarboxylic acid or percarbonate bleaching agents, offer an alternative to the ferric complex bleaching solutions. They are less expensive and present lower chemical and biological demands on the environment since their by-products can be less harmful.

While persulfate bleaching agents have low environmental impact, they have the disadvantage that their bleaching activity is slow and thus require the presence of a bleaching accelerator. The most common bleaching accelerators are thiol compounds that have offensive odors.

Because hydrogen peroxide reacts and decomposes to form water, a peroxide based bleaching solution offers many environmental advantages over persulfate and ferric complex bleaching solutions. As a result, many publications describe peroxide bleaching solutions, including U.S. Pat. No. 4,277,556 (Koboshi et al), U.S. Pat. No. 4,301,236 (Idota et al), U.S. Pat. No. 4,454,224 (Brien et al), U.S. Pat. No. 4,717,649 (Hall et al), and WO-A-92/01972 (published Feb. 6, 1992).

In addition, WO-A-92/07300 (published Apr. 30, 1992) and EP 0 428 101A1 (published May 22, 1991) describe peroxide compositions for bleaching high chloride emulsions. These compositions comprise up to 0.3 mole of chloride ions per liter of solution and have a pH in the range of 5 to 11. These particular bleaching solutions, however, cause vesiculation in the processed element.

WO-A-93/11459 describes peroxide bleaching solutions that include two or more water-soluble sequestering agents for complexing with transition metals. These solutions appear suitable for use with low silver paper materials.

Despite all of the efforts of researchers in the art, no peroxide bleaching composition has been commercialized because of various problems including vesiculation (that is, blistering from evolution of oxygen), poor bleaching efficiency and solution instability.

Improved peroxide bleaching solutions for both low and high chloride emulsions are described in copending and commonly assigned U.S. Ser. No. 08/391,805, filed Feb. 21, 1995 by Haye, O'Toole and Ballou, and U.S. Ser. No. 08/391,993, filed on Feb. 21, 1995 by Haye, Marrese and Bonner. These applications describe the improvements achieved in bleaching efficiency and speed and reduced vesiculation obtained by including at least 0.35 mole of chloride ions per liter of solution.

There remains a need, however, for highly efficient peroxide bleaching solutions which have improved stability.

SUMMARY OF THE INVENTION

The noted problems are solved with a method for processing a color photographic element comprising:

bleaching an imagewise exposed and developed color photographic element with a peroxide bleaching solution, the solution comprising:

a peroxide bleaching agent, chloride ions present in an amount of at least 0.35 mol/l, a first acid that is an organic phosphonic acid or a salt thereof, and a second acid that is a pyridinecarboxylic acid or a salt thereof.

This invention also provides a peroxide bleaching solution comprising:

a peroxide bleaching agent present in an amount of from about 0.15 to about 5 mol/l, chloride ions present in an amount of at least 0.35 mol/l, a first acid that is an organic phosphonic acid or a salt thereof, and a second acid that is a pyridinecarboxylic acid or a salt thereof.

The bleaching solution of this invention provides all of the advantages inherent in the solutions described in the noted copending applications described above, that is, no vesiculation and efficient and rapid bleaching. In addition, however, the solution of this invention has improved stability. That is, the loss in peroxide over time is considerably reduced. Thus, the solution has improved shelf life during shipping and storage.

These advantages are achieved by including in the solution a combination of two different water-soluble acids, each of which are known for different purposes (such as chelating with ferric ions). However, they have not been previously used in combination as sequestrants to stabilize peroxide bleaching solutions. Thus, the discovery that this combination of materials provides this effect in peroxide bleaching solutions is unexpected to us.

BRIEF DESCRIPTION OF THE DRAWING

FIG. 1 is a graphical plot of relative peroxide concentration versus storage time for two bleaching solutions of this invention and a bleaching solution of the prior art, as discussed in Examples 1–2 below.

DETAILED DESCRIPTION OF THE INVENTION

Peroxide bleaching solutions of this invention include a conventional peroxide bleaching agent including, but not limited to hydrogen, alkali and alkaline earth salts of peroxide, or a compound which releases or generates hydrogen peroxide. Such hydrogen peroxide precursors are well known in the art, and include for example, perborate, perphosphate, percarbonate, percarboxylate, and hydrogen peroxide urea. In addition, hydrogen peroxide can be generated on site by electrolysis of an aqueous solution. Examples of peroxide bleaching solutions are described, for example, in *Research Disclosure,* publication 36544, pages 501–541 (September, 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Hydrogen peroxide is a preferred bleaching agent.

The amount of hydrogen peroxide (or its precursor) is generally at least 0.15 mol/l, and from about 0.15 to about 5 mol/l is preferred. The optimum amount will depend upon the type of photographic element being processed. For example, for color negative films that contain silver bromoiodide emulsions, more preferred amounts are from about 0.9 to about 3 mol/l. The most preferred amounts for silver bromoiodide emulsions are from about 1.45 to about 2.0 mol/l. For motion picture print films, the more preferred amount is from about 0.15 to about 1 mol/l, and a most preferred amount is from about 0.35 to about 0.6 mol/l. For photographic color papers, the preferred amounts would be from about 0.15 to about 3 mol/l.

Chloride ions can be supplied to the bleaching solution as part of a simple inorganic salt, for example, sodium chloride, potassium chloride, ammonium chloride and lithium chloride. In addition, they can be supplied as organic complexes such as tetraalkylammonium chlorides. The preferred salts are sodium chloride and potassium chloride.

The chloride ion concentration is at least 0.35 mol/l, with from 0.35 to about 2 mol/l being preferred, and from 0.35 to about 1 mol/l being most preferred.

The bleaching solutions of this invention are quite simple, having four essential components: the peroxide bleaching agent, the chloride ions, and two distinct sequestrant acids, as defined below. An optional but preferred component is a buffer.

The bleaching solution of this invention is alkaline, having a pH within the general range of from about 7 to about 13, with a pH of from about 8 to about 11 being preferred. The pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, beta-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium or potassium carbonate are preferred.

The amount of useful buffer or base would be readily apparent to one skilled in the art.

The first acid can be one or more organic phosphonic acids or salts thereof. Generally such compounds are represented by the structure (I):

$$R_1N(CH_2PO_3M_2)_2$$

or (II):

$$R_2R_3C(PO_3M_2)_2$$

wherein $R_1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, o-octamidobenzyl or β-phenethyl), a substituted or unsubstituted alkylaminoalkyl group (wherein the alkyl portion of the group is as defined above, such as methylaminoemethyl or ethylaminoethyl), a substituted or unsubstituted alkoxyalkyl group of 1 to 12 carbon atoms (such as methoxymethyl, methoxyethyl, propoxyethyl, benzyloxy, methoxymethylenemethoxymethyl or t-butoxy), a substituted or unsubstituted cycloalkyl group of 5 to 10 carbon atoms (such as cyclopentyl, cyclohexyl, cyclooctyl or 4-methylcyclohexyl), a substituted or unsubstituted aryl group of 6 to 10 carbon atoms (such as phenyl, xylyl, tolyl, naphthyl, p-methoxyphenyl or 4-hydroxyphenyl), or a substituted or unsubstituted 5- to 10-membered heterocyclic group having one or more nitrogen, oxygen or sulfur atoms in the ring besides carbon atoms [such as pyridyl, primidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R_2$ is hydrogen, a substituted or unsubstituted alkyl group of 1 to 12 carbon atoms (as defined above), a substituted or unsubstituted aryl group of 6 to 10 carbon atoms (as defined above), a substituted or unsubstituted cycloalkyl group of 5 to 10 carbon atoms (as defined above), a substituted or unsubstituted 5- to 10-membered heterocyclic group (as defined above), $—PO_3M_2$ or $—CHR_4PO_3M_2$.

$R_3$ is hydrogen, hydroxyl, a substituted or unsubstituted alkyl group of 1 to 12 carbon atoms (defined above) or $—PO_3M_2$.

$R_4$ is hydrogen, hydroxyl, a substituted or unsubstituted alkyl group of 1 to 12 carbon atoms (as defined above) or $—PO_3M_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups herein, useful substituents include, but are not limited to, an alkyl group, hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_3M_2$, $—CH_2PO_3M_2$ or $—N(CH_2PO_3M_2)_2$ wherein the alkyl (linear or branched) for any of these groups has 1 to 5 carbon atoms.

Representative phosphonic acids useful in the practice of this invention include, but are not limited to the compounds listed in EP 0 428 101A1 (page 4). Representative useful compounds are 1-hydroxyethylidene- 1,1-diphosphonic acid, diethylenetriaminepentaphosphonic acid, ethylenediamine-N,N,N',N'-tetramethylenephosphonic acid, nitrilo-N,N,N-trimethylenephosphonic acid, 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diamine-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridinylmethylamine-N,N-dimethylenephosphonic acid, 1-hydroxyethane-1,1-diphosphonic acid, diethylenetriamine-N,N,N',N",N"-penta(methylenephosphonic acid), 1-hydroxy-2-phenylethane- 1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid, or salts thereof.

Particularly useful are 1-hydroxyethylidene- 1,1-diphosphonic acid, nitrilo-N,N,N-trimethylenephosphonic acid, diethylenetriamine-N,N,N',N",N"-penta(methylenephosphonic acid), or salts thereof. The first compound is most preferred.

The amount of organic phosphonic acid used in the practice of the invention is at least about 0.0005 mol/l and generally up to about 0.03 mol/l. An amount of from about 0.0025 to about 0.012 mol/l is preferred.

A second acid component in the bleaching solution is a compound which generally comprises at least one carboxyl group and an aromatic nitrogen hetrocycle. They are water-soluble and preferably biodegradable.

More specifically, this second group of acids includes substituted or unsubstituted 2-pyridinecarboxylic acids and substituted or unsubstituted 2,6-pyridinedicarboxylic acids (or equivalent salts). The substituents which may be on the pyridinyl ring include substituted or substituted alkyl, substituted or unsubstituted cycloalkyl or substituted or unsubstituted aryl groups (as defined above for structures I–II), hydroxy, nitro, sulfo, amino, carboxy, sulfamoyl, sulfonamide, phospho, halo or any other group that does not interfere with ferric ion ternary complex formation, stability, solubility or catalytic activity. The substituents can also be the atoms necessary to form a 5- to 7-membered fused ring between any of the positions of the pyridinyl nucleus.

The preferred acids of this type are represented by the following structures:

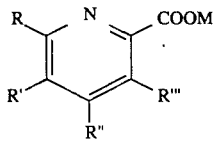

(III)

and

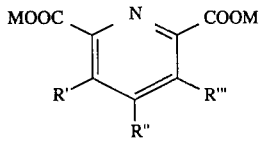

(IV)

wherein R, R', R" and R''' are independently hydrogen, a substituted or unsubstituted alkyl group of 1 to 5 carbon atoms (as defined above), a substituted or unsubstituted aryl group of 6 to 10 carbon atoms (as defined above), a substituted or unsubstituted cycloalkyl group of 5 to 10 carbon atoms (as defined above), hydroxy, nitro, sulfo, amino, carboxy, sulfamoyl, sulfonamido, phospho or halo (such as chloro or bromo), or any two of R, R', R" and R''' can comprise the carbon atoms necessary to form a substituted or unsubstituted 5 to 7-membered ring fused with the pyridinyl nucleus.

The monovalent and divalent radicals defining Structures III and IV can have substituents like those defining the radicals for Structures I–II above. M is as defined above.

Preferably, R, R', R" and R''' are independently hydrogen, hydroxy or carboxy. The most preferred compounds are unsubstituted 2-pyridinecarboxylic acid and 2,6-pyridinedicarboxylic acid or salts thereof.

The amount of the second acid used in the practice of this invention is at least about 0.001 to about 0.05 mol/l. Preferred amounts are from about 0.002 to about 0.035 mol/l.

The acids can be obtained from a number of commercial sources or prepared using conventional procedures and starting materials (see for example, Syper et al, *Tetrahedron*, 36, 123–129, 1980 and Bradshaw et al, *J.Am.Chem.Soc.*, 102(2), 467–74, 1980).

As used herein, the terms "biodegradable" or "biodegradability" refer to at least 80% decomposition in the standard test protocol specified in by the Organization for Economic Cooperation and Development (OECD), Test Guideline 302B (Paris, 1981), also known as the "Modified Zahn-Wellens Test".

As used herein in defining concentrations of reagents and times, the term "about" refers to ±20% of the indicated amount. In defining pH values, the term "about" refers to ±0.5 unit. In defining temperature, the term "about" refers to ±5° C.

The color photographic elements to be processed using the present invention can contain any of the conventional silver halide emulsions. They can be "high chloride" or "low chloride" emulsions, but preferably they are "high chloride" emulsions. Thus, other emulsions are also useful, including but not limited to, silver bromide, silver iodide, silver bromoiodide, silver chloroiodide, silver chlorobromide, silver bromochloroiodide and silver chlorobromoiodide. By "high chloride" emulsions is meant those having at least 50 mol % of chloride as the halide component of the emulsion grains. More preferably, they contain at least 90 mol % of chloride. "Low chloride" emulsions mean those having less than 30 mol % of chloride, and preferably less than 10 mol % of chloride. The high chloride emulsions contain less than 5 mol % of iodide, and preferably no iodide.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure*, noted above. All types of emulsions can be used in the elements, including but not limited to, thin tabular grain emulsions, and either positive-working or negative-working emulsions. The elements can be either photographic film or paper elements.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Color developers are well known and described in many publications including the *Research Disclosure* noted above. In addition to color developing agents, the color developer generally contains a buffer (such as potassium carbonate), a sulfite, chelating agents, halides, and one or more antioxidants as preservatives. There are many classes of useful antioxidants including, but not limited to, hydrazines and substituted or unsubstituted hydroxylamines. By substituted hydroxylamines is meant, for example, those having one or more alkyl or aryl groups connected to the nitrogen atom. These alkyl or aryl groups can be further substituted with one or more groups such as sulfo, carboxy, hydroxy, alkoxy, and other groups known in the art which provide solubilizing effects. Examples of such hydroxylamines are described, for example, in U.S. Pat. No. 4,876,174 (Ishikawa et al), U.S. Pat. No. 4,892,804 (Vincent et al), U.S. Pat. No. 5,178,992 (Yoshida et al) and U.S. Pat. No. 5,354,646 (Kobayashi et al).

Development can also be carried out using what is known in the art as a "developer/amplifier" solution, as described in U.S. Pat. No. 5,324,624 (Twist).

Development is then followed by the use of a bleaching solution as described herein. The bleaching and fixing steps can be carried out in any suitable fashion, as is known in the art. Subsequent to bleaching and fixing, a final washing or stabilizing step may be employed. Color prints and films can be processed using a wide variety of processing protocols, as described for example, in *Research Disclosure,* noted above, and thus can include various combinations of one or more bleaching, fixing, washing or stabilizing steps in various orders, and lastly, drying. Additionally, reversal processes include additional steps of black and white development, chemical fogging, re-exposure and washing prior to color development.

Processing according to the present invention can be carried out using conventional deep tanks holding processing solutions. Alternatively, it can be carried out using what is known in the art as "low volume thin tank" processing systems having either rack and tank or automatic tray designs. Such processing methods and equipment are described, for example, in recently allowed U.S. Ser. No. 08/221,711 (filed Mar. 31, 1994 by Carli et al), now U.S. Pat. No. 5,436,118, and publications noted therein.

The following examples are presented to illustrate the practice of this invention, and are not intended to be limiting in any way. Unless otherwise indicated, all percentages are by weight.

EXAMPLES 1–2

Processing of Color Paper Using Stabilized Bleaching Solutions

Two bleaching solutions of this invention were evaluated for bleaching effectiveness according to the present invention. They were also evaluated for storage stability. Several comparison bleaching solutions were similarly evaluated.

Samples of EKTACOLOR EDGE™ photographic color paper were subjected to a step wedge test object for 1/10 second with HA-50 and NP-11 filters, a 0.3 Inconel and a 3000K color temperature lamp on a conventional 1B-sensitometer. They were then processed using the following protocol (under nitrogen) wherein the bleaching time was varied to determine bleaching effectiveness.

| | |
|---|---|
| 45 seconds | Development* |
| 30 seconds | Stop solution (1% v/v $H_2SO_4$) |
| 30 seconds | Water wash |
| 0-2 minutes | Bleaching |
| 30 seconds | Water wash |
| 1 minute | Fixing** |
| 2 minutes | Water wash |
| 5 minutes | Dry. |

*The developing solution (per liter) was a conventional KODAK EKTACOLOR ™ RA Color Developer.
**The fixing solution (per liter) was an aqueous solution of sodium metabisulfite (11.8 g) and a solution (162 ml) of ammonium thiosulfate (56.5%) and ammonium sulfite (4%), and had a pH of 6.5.
KODAK PHOTO-FLO ™ is a commercially available rinse.

A Control A bleaching solution contained hydrogen peroxide (0.98 mol/l. 3% w/w), potassium chloride (0.35 mol/l), potassium carbonate (0.025 mol/l), potassium bicarbonate (0.025 mol/l) and 1-hydroxyethylidene- 1,1-diphosphonic acid (0.004 mol/l), and was adjusted to pH 10 using potassium hydroxide.

A Control B bleaching solution contained hydrogen peroxide (0.98 mol/l, 3% w/w), potassium chloride (0.35 mol/l), potassium carbonate (0.025 mol/l), potassium bicarbonate (0.025 mol/l) and 2-pyridinecarboxylic acid (0.035 mol/l), and was adjusted to pH 10 using potassium hydroxide.

A Control C bleaching solution contained hydrogen peroxide (0.98 mol/l, 3% w/w), potassium chloride (0.35 mol/l), potassium carbonate (0.025 mol/l), potassium bicarbonate (0.025 mol/l) and 2,6-pyridinedicarboxylic acid (0.035 mol/l), and was adjusted to pH 10 using potassium hydroxide.

A Control D bleaching solution was like Control A except that the phosphonic acid was omitted.

An Example 1 bleaching solution contained hydrogen peroxide (0.98 mol/l, 3% w/w), potassium chloride (0.35 mol/l), potassium carbonate (0.025 mol/l), potassium bicarbonate (0.025 mol/l), 1-hydroxyethylidene- 1,1-diphosphonic acid (0.004 mol/l) and 2-pyridinecarboxylic acid (0.035 mol/l), and was adjusted to pH 10 using potassium hydroxide.

An Example 2 bleaching solution contained hydrogen peroxide (0.98 mol/l, 3% w/w), potassium chloride (0.35 mol/l), potassium carbonate (0.025 mol/l), potassium bicarbonate (0.025 mol/l), 1-hydroxyethylidene- 1,1-diphosphonic acid (0.004 mol/l) and 2,6-pyridinedicarboxylic acid (0.035 mol/l), and was adjusted to pH 10 using potassium hydroxide.

FIG. 1 shows stability data for the Controls A–C, Example 1 and Example 2 bleaching solutions. These solutions were stored at room temperature for a number of days. After certain number of days, samples of the solutions were evaluated for the amount of hydrogen peroxide remaining. This evaluation was achieved electroanalytically by cyclic voltammetry using a mercury drop electrode. The electroanalytical data were recorded using a conventional EG&G Princeton Applied Research Potentiostat/Galvanostat, Model 273A. The results were plotted as Relative Peroxide Concentration (%) versus time (days). The data for Controls B, C and D were the same, as shown in FIG. 1.

From these data, it is clear that the Control B, C and D bleaching solutions decomposed with a day, and the Control A solution decomposed with a halflife of about 7 days. The Example 1 and 2 solutions of this invention had much improved stability. Example 1 decomposed with a halflife of about 21 days, and Example 2 showed very little decomposition after 50 days at room temperature. Thus, it is clear that the combination of a phosphonic acid with a pyridinecarboxylate provides a synergistic improvement in bleaching solution stability over the use of each compound individually.

Residual silver ($g/m^2$) was determined by X-ray fluorescence using conventional procedures. The results are tabulated below in Table I for certain density exposures after 45 seconds. Results are also presented for the use of the conventional KODAK EKTACOLOR™ RA bleach-fixing solution.

TABLE I

| Step Number | RA ($g/m^2$) | Control A ($g/m^2$) | Control B ($g/m^2$) | Control C ($g/m^2$) | Example 1 ($g/m^2$) | Example 2 ($g/m^2$) |
|---|---|---|---|---|---|---|
| 1 | 0.04 | 0.03 | 0.67 | 0.67 | 0.01 | 0.02 |
| 3 | 0.05 | 0 | 0.62 | 0.61 | 0.03 | 0.02 |
| 5 | 0.05 | 0.02 | 0.60 | 0.56 | 0.05 | 0.02 |
| 7 | 0.03 | 0 | 0.49 | 0.44 | 0.01 | 0.01 |
| 9 | 0.03 | 0 | 0.26 | 0.2 | 0.02 | 0 |
| 11 | 0 | 0 | 0.06 | 0.04 | 0.02 | 0.01 |
| 13 | 0 | 0.01 | 0.01 | 0 | 0 | 0 |
| 15 | 0 | 0 | 0.01 | 0 | 0 | 0 |
| 17 | 0 | 0 | 0.01 | 0 | 0.02 | 0 |
| 19 | 0 | 0.02 | 0.02 | 0.01 | 0 | 0.02 |
| 21 | 0 | 0 | 0.01 | 0.02 | 0.01 | 0.01 |

The results indicate that the Control B and C bleaching solutions, containing only a "second" acid did not provide effective bleaching after 45 seconds. The Control A bleaching solution, containing only a "first" acid did provide acceptable bleaching. However, as shown in FIG. 1, the Control A bleaching solution was not acceptably stable after storage for 14 days at room temperature. The Example 1 and 2 bleaching solutions demonstrated considerably better storage stability over the test period. No vesiculation was observed with use of the present invention. The results also show that use of the present invention provided comparable bleaching to the conventional KODAK EKTACOLOR™ RA bleach-fixing solution after storage for 21 days.

The invention has been described in detail with particular reference to preferred embodiments thereof, but it will be understood that variations and modifications can be effected within the spirit and scope of the invention.

We claim:

1. A method for processing a color silver halide photographic element comprising:

bleaching an imagewise exposed and developed color silver halide photographic element with a bleaching solution comprising:

a peroxide bleaching agent, chloride ions present in an amount of at least 0.35 mol/l, a first acid that is an organic phosphonic acid or a salt of said first acid, and a second acid that is a 2-pyridinecarboxylic acid or 2,6-pyridinedicarboxylic acid, or alkali metal or ammonium salts of said second acid.

2. The method of claim 1 wherein said bleaching agent is hydrogen peroxide.

3. The method of claim 1 wherein said bleaching solution comprises said chloride ions in an amount of from 0.35 to about 2 mol/l.

4. The method of claim 3 wherein said bleaching solution comprises said chloride ions in an amount of from 0.35 to about 1 mol/l.

5. The method of claim 1 wherein said bleaching solution has a pH of from about 7 to about 13.

6. The method of claim 1 wherein said first acid is an organic phosphonic acid having the structure (I):

$$R_1N(CH_2PO_3M_2)_2$$

or the structure (II):

$$R_2R_3C(PO_3M_2)_2$$

wherein $R_1$ is hydrogen, an alkyl group of 1 to 12 carbon atoms, an alkylaminoalkyl group, an alkoxyalkyl group of 1 to 12 carbon atoms, a cycloalkyl group of 5 to 10 carbon atoms, an aryl group of 6 to 10 carbon atoms, or a heterocyclic group having 5 to 10 atoms in the ring, $R_2$ is hydrogen, an alkyl group of 1 to 12 carbon atoms, an aryl group of 6 to 10 carbon atoms, a cycloalkyl group of 5 to 10 carbon atoms, a heterocyclic group having 5 to 10 atoms in the ring, $—PO_3M_2$ or $—CHR_4PO_3M_2$, $R_3$ is hydrogen, hydroxyl, an alkyl group of 1 to 12 carbon atoms or $—PO_3M_2$, $R_4$ is hydrogen, hydroxyl, an alkyl group of 1 to 12 carbon atoms or $—PO_3M_2$, and M is hydrogen or a monovalent cation.

7. The method of claim 6 wherein said organic phosphonic acid or salt thereof is 1-hydroxyethylidene- 1,1-diphosphonic acid, nitrilo-N,N,N-trimethylenephosphonic acid, diethylenetriamine-N,N,N',N",N"-penta(methylenephosphonic acid), or salts thereof.

8. The method of claim 1 wherein said organic phosphonic acid or salt thereof is present in an amount of from about 0.0005 to about 0.03 mol/l.

9. The method of claim 8 wherein said organic phosphonic acid or salt thereof is present in an amount of from about 0.0025 to about 0.012 mol/l.

10. The method of claim 1 wherein said second acid has either the structure (III):

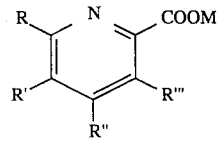

or:

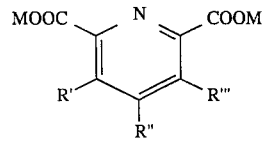

(IV)

wherein R, R', R" and R''' are independently hydrogen, an alkyl group of 1 to 5 carbon atoms, an aryl group of 6 to 10 carbon atoms, a cycloalkyl group of 5 to 10 carbon atoms, hydroxy, nitro, sulfo, amino, phospho, carboxy, sulfamoyl, sulfonamido or halo, or any two of R, R', R" and R'" can comprise the carbon atoms necessary to form a 5 to 7-membered ring fused with the pyridinyl nucleus, and M is hydrogen or a monovalent cation.

11. The method of claim 10 wherein said second acid is 2-pyridinecarboxylic acid, 2,6-pyridinedicarboxylic acid, or alkali metal or ammonium salts of said second acid.

12. The method of claim 1 wherein said second acid is present in an amount of from about 0.001 to about 0.05 mol/l.

13. The method of claim 1 wherein said bleaching agent is present in an amount of from about 0.15 to about 5 mol/l.

14. The method of claim 1 wherein said peroxide bleaching agent is present in an amount of from about 0.15 to about 5 mol/l, said chloride ions are present in an amount of from about 0.35 to about 2 mol/l, said a first acid is present in an amount of from about 0.0005 to about 0.03 mol/l, and a second acid is present in an amount of from about 0.001 to about 0.05 mol/l.

15. The method of claim 1 wherein said bleaching solution has a pH of from about 8 to about 11, and wherein said bleaching agent is hydrogen peroxide.

16. The method of claim 1 wherein said organic phosphonic acid has the structure (I):

$$R_1N(CH_2PO_3M_2)_2$$

or the structure (II):

$$R_2R_3C(PO_3M_2)_2$$

wherein $R_1$ is hydrogen, an alkyl group of 1 to 12 carbon atoms, an alkylaminoalkyl group, an alkoxyalkyl group of 1 to 12 carbon atoms, a cycloalkyl of 5 to 10 carbon atoms, an aryl group of 6 to 10 carbon atoms, or a heterocyclic group having 5 to 10 atoms in the ring, $R_2$ is hydrogen, an alkyl group of 1 to 12 carbon atoms, an aryl group of 6 to 10 carbon atoms, a cycloalkyl group of 5 to 10 carbon atoms, a heterocyclic group having 5 to 10 atoms in the ring, $—PO_3M_2$, or $—CHR_4PO_3M_2$, $R_3$ is hydrogen, hydroxyl, an alkyl group of 1 to 12 carbon atoms or $—PO_3M_2$, $R_4$ is hydrogen, hydroxyl, an alkyl group of 1 to 12 carbon atoms or $—PO_3M_2$, and M is hydrogen or a monovalent cation, and said second acid has either the structure:

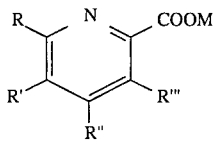

(III)

or

-continued

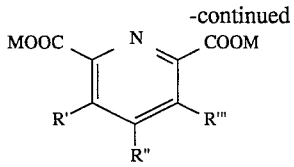

(IV)

wherein R, R', R" and R'" are independently hydrogen, an alkyl group of 1 to 5 carbon atoms, an aryl group of 6 to 10 carbon atoms, a cycloalkyl group of 5 to 10 carbon atoms, hydroxy, nitro, sulfo, amino, phospho, carboxy, sulfamoyl, sulfonamido or halo, or any two of R, R', R" and R'" can comprise the carbon atoms necessary to form a 5 to 7-membered ring fused with the pyridinyl nucleus, and M is hydrogen or a monovalent cation.

17. A method for processing a color silver halide photographic element comprising:

bleaching an imagewise exposed and developer color silver halide photographic element with a bleaching solution comprising:

hydrogen peroxide as bleaching agent, chloride ions present in an amount of at least 0.35 mol/l, a first acid that is an organic phosphonic acid, or a salt of said first acid, said first acid having the the structure (I):

$$R_1N(CH_2PO_3M_2)_2$$

or the structure (II):

$$R_2R_3C(PO_3M_2)_2$$

wherein $R_1$ is hydrogen, an alkyl group of 1 to 12 carbon atoms, an alkylaminoalkyl group, an alkoxyalkyl group of 1 to 12 carbon atoms, a cycloalkyl of 5 to 10 carbon atoms, an aryl group of 6 to 10 carbon atoms, or a heterocyclic group having 5 to 10 atoms in the ring, $R_2$ is hydrogen, an alkyl group of 1 to 12 carbon atoms, an aryl group of 6 to 10 carbon atoms, a cycloalkyl group of 5 to 10 carbon atoms, a heterocyclic group having 5 to 10 atoms in the ring, $—PO_3H_2$, or $—CHR_4PO_3H_2$, $R_3$ is hydrogen, hydroxyl, an alkyl group of 1 to 12 carbon atoms or $—PO_3H_2$, $R_4$ is hydrogen, hydroxyl, an alkyl group of 1 to 12 carbon atoms or $—PO_3H_2$, and M is hydrogen or a monovalent cation, and a second acid, or an alkali metal or ammonium salt of said second acid, said second acid having either the structure:

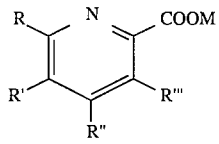

(III)

or

-continued

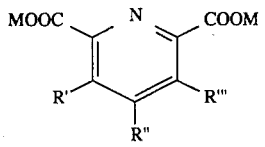

(IV)

wherein R, R', R'' and R''' are independently hydrogen, an alkyl group of 1 to 5 carbon atoms, an aryl group of 6 to 10 carbon atoms, a cycloalkyl group of 5 to 10 carbon atoms, hydroxy, nitro, sulfo, amino, phospho, carboxy, sulfamoyl, sulfonamido or halo, or any two of R, R', R'' and R''' can comprise the carbon atoms necessary to form a 5 to 7-membered ring fused with the pyridinyl nucleus, and M is hydrogen or a monovalent cation.

18. A method for processing a color silver halide photographic element comprising:

bleaching an imagewise exposed and developed color silver halide photographic element with a bleaching solution comprising:

hydrogen peroxide as bleaching agent, chloride ions present in an amount of at least 0.35 mol/l, a first acid, or a salt of said first acid, said first acid being 1-hydroxyethylidene-1,1-diphosphonic acid, nitrilo-N,N,N-trimethylenephosphonic acid, or diethylenetriamine-N,N,N',N'',N''-penta(methylenephosphonic acid), and a second acid, or an alkali metal or ammonium salt of said second acid, said second acid being 2-pyridinecarboxylic acid or 2,6-pyridinedicarboxylic acid.

* * * * *